US011905714B1

(12) United States Patent
Sinila et al.

(10) Patent No.: US 11,905,714 B1
(45) Date of Patent: Feb. 20, 2024

(54) MOSAIC TILE ASSEMBLY FOR INSTALLATION ON A FLOOR OR WALL SURFACE

(71) Applicant: Sawica International, LLC, Aventura, FL (US)

(72) Inventors: Roberto Alejandro Sinila, Aventura, FL (US); Federico Alberto Sinila, Aventura, FL (US); Juan Martin Sinila, Aventura, FL (US)

(73) Assignee: Sawica International, LLC, Aventura, FL (US)

( * ) Notice: Subject to any disclaimer, the term of this patent is extended or adjusted under 35 U.S.C. 154(b) by 0 days.

(21) Appl. No.: 17/703,030

(22) Filed: Mar. 24, 2022

(51) Int. Cl.
*E04F 13/08* (2006.01)
*E04F 15/10* (2006.01)

(52) U.S. Cl.
CPC ..... *E04F 13/0839* (2013.01); *E04F 15/10* (2013.01)

(58) Field of Classification Search
CPC ... E04F 13/0839; E04F 15/10; E04F 13/0846; E04F 13/0832
See application file for complete search history.

(56) References Cited

U.S. PATENT DOCUMENTS

| | | | | |
|---|---|---|---|---|
| 2,876,574 | A | 3/1959 | Powell | |
| 4,856,246 | A | 8/1989 | Shimasaki | |
| 7,987,646 | B2 * | 8/2011 | Race | E04F 13/0842 52/506.04 |
| 9,133,626 | B2 | 9/2015 | Song | |
| 10,870,993 | B2 * | 12/2020 | Steffes | E04F 13/0894 |
| 11,498,357 | B2 * | 11/2022 | Briggs | E04F 15/022 |
| 2005/0188642 | A1 * | 9/2005 | Correia | E04F 13/0862 52/506.1 |
| 2016/0068012 | A1 | 3/2016 | Muller | |

FOREIGN PATENT DOCUMENTS

| | | | |
|---|---|---|---|
| AR | 097612 | A4 | 4/2016 |
| BR | 202015021468 | | 3/2016 |
| CN | 1012938378 | | 11/2008 |
| CN | 101589002 | | 11/2009 |
| CN | 102667029 | | 9/2012 |
| CN | 205369784 | | 7/2016 |
| EP | 0080260 | | 6/1983 |
| ES | 1144035 | U | 9/2015 |

* cited by examiner

*Primary Examiner* — Adriana Figueroa
(74) *Attorney, Agent, or Firm* — Allen, Dyer, Doppelt & Gilchrist, P.A.

(57) ABSTRACT

A mosaic tile assembly manufactured in a mold via a continuous plastic injection process. The tile assembly comprises a plurality of tiles disposed in a staggered, offset arrangement of rows that avoids the intersection of four tile corners. Each mosaic tile generally comprises a front face configured for exposure to the exterior and back face configured for attachment to the floor or wall surface. The back face comprises a surface and a plurality of grooves disposed in a predetermined array of perpendicularly disposed vertical and horizontal grooves. The horizontal grooves of successive adjacent tiles within a row may be aligned with one another whereas different vertical grooves of adjacently disposed tiles, above and below, may be aligned with one another to form the offset arrangement. The tile assembly may also comprise a plurality of interconnecting links that may formed in the same mold during the same plastic injection process.

16 Claims, 8 Drawing Sheets

MOSAIC TILE ASSEMBLY FOR INSTALLATION ON A FLOOR OR WALL SURFACE

FIELD OF INVENTION

The present invention relates to the field of mosaic tile assemblies.

BACKGROUND

Mosaic tiles manufactured with synthetic, inorganic and/or non-metallic materials such as ceramics or clay-based materials have generally involved significant drawbacks. Generally, their manufacturing process is more costly and difficult than mosaic tiles comprising other synthetic materials, for example, plastics and/or other materials with a polymer base. One reason for this is the fact the melting point of plastics is much lower than ceramics and clay derivatives, which need to be manufactured, treated and/or processed at significantly higher temperatures. In addition, plastics are much easier to convey into molds to ensure a uniform fabrication and/or provide for an increased quality control during manufacturing. In addition, ceramics and clay products are relatively brittle and fragile, and consequently, they are susceptible to damage due to breakage, rupture, scratching, chipping, and other cosmetic imperfections and/or physical damage, which may result during manufacturing, transport and/or installation. As a result, mosaic tiles made from ceramics and clay products are associated with higher costs of production, installation and/or maintenance.

Accordingly, there is a need in the industry to provide for a mosaic tile assembly comprising a plastic with a polymer base, which may be manufactured through a mold injection process. The industry would further benefit if such a tile assembly were to be provided with grooves or indentations in the back face of the mosaic tiles to facilitate installation onto a floor or wall surface. An even further benefit would be realized if such grooves were provided in an optimal alignment that would enhance the structural integrity of the tile assembly and its adhesion to the floor or wall surface.

SUMMARY

The present invention is directed towards a mosaic tile assembly that may be manufactured in a mold via a continuous plastic injection process. The present invention is also directed to a method of installing the inventive tile to the floor or wall surface. The inventive tile assembly comprises a plurality of tiles disposed in staggered rows and generally made from a plastic comprising a polymer base, which may be melted and injected into a mold during manufacturing. Each mosaic tile generally comprises a front face configured for exposure to the exterior and back face configured for attachment to the floor or wall surface. The back face generally comprises a back surface and a plurality of grooves disposed in a predetermined array. The predetermined array may comprise perpendicularly disposed vertical and horizontal grooves. The horizontal grooves of different adjacent mosaic tiles within a row may be aligned with one another. The vertical grooves of adjacent mosaic tiles of different rows, e.g., rows above and/or below, may be aligned with one another. Therefore, the mosaic tiles of one row may be disposed in an offset horizontal relation to the tiles of a row above and/or below. This is intended to eliminate intersections of four different tile corners, which hare otherwise weak and/or undesirable spots. The tile assembly may also comprise a plurality of interconnecting links that may formed in the same mold during the same plastic injection process.

The inventive method comprises providing a tile assembly according to the present invention and prepping or otherwise preparing the floor or wall surface be leveling it and/or providing moisture to the surface. The method may further comprise applying an adhesive material to form an adhesive layer on the floor or wall surface, forming an adhesive layer of up to five millimeters in thickness. The method may further comprise installing or otherwise placing the tile assembly or sections thereof on the adhesive layer and/or rotating, re-installing, repositioning, and/or adjusting the depth of the tile assembly to install it in a desired location within the floor or wall surface. The mosaic tiles may be gently tapped to adjust their relative depth with respect to the thickness of the adhesive layer and/or the location of the floor or wall surface. Furthermore, tapping of the tiles may also enhance the distribution of the adhesive material through the grooves of the tiles. The adhesive material may comprise a cementitious mixture, thin set, glue, grout, epoxy, or other related material. The adhesive material should comprise an initial curing period in which it is malleable or soft, such that the installer may reposition or adjust the position of the tile assembly during installation. The adhesive material should also be able to cure through time to firmly hold the tile assembly in place during its intended operable lifespan.

DETAILED DESCRIPTION

Figure 1:
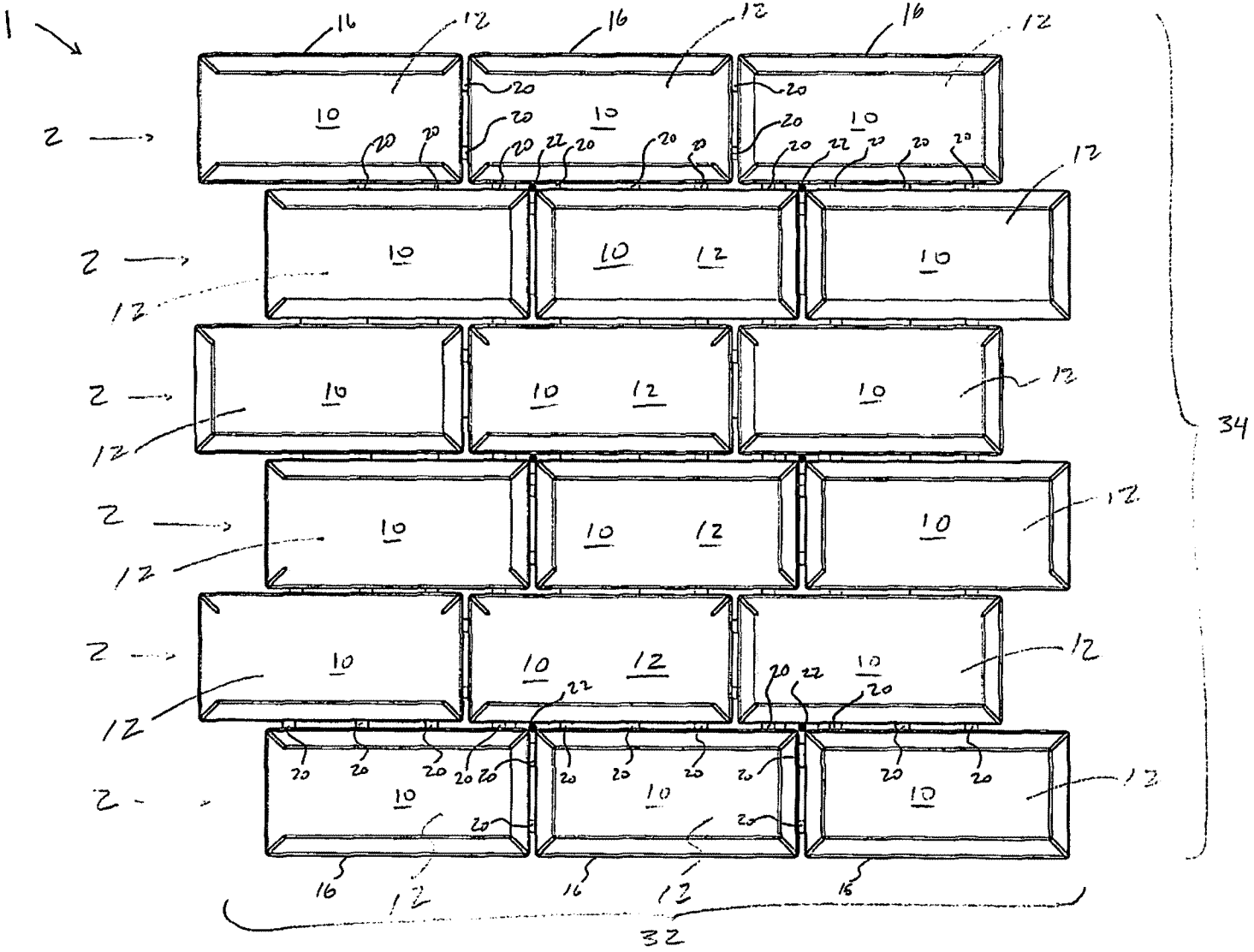
FIG. 1. is a top view of one embodiment of the front faces of the tiles of the mosaic tile assembly according the present invention.

With initial reference to FIGS. 1-8, the present invention is directed towards a mosaic tile assembly 1 configured for installation onto a floor or wall surface, and to method 100 of installing the mosaic tile assembly 1 onto the floor or wall surface. As used herein, a "floor or wall surface" or simply "a surface" may include, without limitation, surfaces of indoor or outdoor spaces such as surfaces of bathrooms, kitchens, closets, rooms, showers, pools, Jacuzzis or spas, gyms, or any other floor or wall surface where a mosaic pattern is desired. As is perhaps best appreciated from FIGS. 1-2 and 5-6, the mosaic tile assembly 1 according to the present invention primary comprises a plurality of mosaic tiles, which are indicated at 10, which may be successively disposed in horizontal rows 2. As used herein, the terms "tiles" and "mosaic tiles" are interchangeable. As will be explained in more detail, the individual tiles 10 of an assembly may be defined or otherwise formed in plastic mold process comprising a continuous injection.

With reference to FIGS. 1-6, individual rows 2 of mosaic tiles 10 may be disposed on top, or below, one another forming an assembly that is intended to cover an intended area of the floor or wall surface. As will be explained in more detail below, the individual rows 2 are generally disposed in an staggered arrangement that avoids four corners of separate tiles meeting at a common point of intersection. Instead, it is contemplated that only the two corners, two top corners and/or tow bottom corners, of adjacently disposed times of the same row will meet at a common point. This is intended to at least partially increase the structural integrity of the mosaic tile assembly 1 and to reduce weakness points, i.e., four corners meeting at the same intersection point. Furthermore, as will be explained herein, the back face 14 of the individual tiles 10 may be provided with a predetermined array of horizontal grooves 24 and/or vertical grooves 26. The predetermined array of grooves 24 and/or 26 is not only intended to facilitate adhesion to floor or wall surface, but may enable operative alignments of the grooves 24 and/or 26 of different mosaic tiles 10, which also serves to at least partially increase the structural integrity of the overall assembly 1.

With reference to at least FIGS. 1-6, the individual tiles 10 may comprise vertical sides 18 and horizontal sides 16. The vertical sides 18 and horizontal tiles 16 of each tile may collectively define a quadrilateral shape of the tile 10, which may include a substantially square shape, i.e., FIGS. 5-6, a substantially rectangular shape, i.e., FIGS. 1-4, or another related quadrilateral shape, e.g., rhomboidal, etc. As such, each mosaic tile generally comprises four sides, two vertical sides 18 and two horizontal sides 16. Generally, the vertical sides 18 of adjacent tiles 10 of the same row 2 will be adjacently disposed to one another such that there is a full overlap between the vertical sides 18. Conversely, it is contemplated that there only be a partial overlap between the horizontal sides 16 of adjacent tiles of consecutive rows 2. Further, it is also contemplated that the side 16 of a left most or right most tile 10 at least partially overlap with the horizontal side 16 at least one tile 10 from an adjacent row 2, e.g., at the left or right end of the tile assembly 1. It is also contemplated that the horizontal side 16 of a tile 10 that is not at the ends of the tile assembly, at least partially overlap with the horizontal side 16 of two adjacent tiles of the rows 2 either above or below. It should be understood that the top horizontal side 16, or bottom horizontal side 16, of some tiles 10 will not have an adjacently disposed row 2 of tiles 10 as these tiles will be at the edges, i.e., top, bottom, sides, of the assembly 1.

As may be appreciated from FIGS. 1-2 and 5-6, the top row 2 of mosaic tiles 10, the bottom row 2 of mosaic tiles 10, the leftmost or first tiles 10 of each row 2, and the rightmost or last tile 10 of each row 2, also will not have adjacently disposed tiles 10, respectively to the top, bottom, left and right. As a further example, the top most row 2, or bottom most row of a tile assembly 1 may be disposed against another structure, i.e., baseboard, backsplash, ceiling, wall, mirror, or even another tile assembly 1 or portion thereof. As is also shown in FIGS. 1-2 and 5-6, it should also be noted that the contemplated staggered arrangement, will result in an uneven left and right side of the tile assembly 1. Thus, it is also within the scope of the present invention that the plurality of tiles 10 may be cut in the vertical direction to produce a substantially even right or left edge with a substantially straight alignment comprising a plurality of full and half tiles 10, i.e., the ones that are cut.

By way of example, a mosaic tile assembly 1 according to the present invention may be provided with approximately 144 tiles 10, each one comprising vertical sides 18 of about 25 millimeters, horizontal sides 16 of about 25 to about 50 millimeters, or more, and a thickness of about 2 millimeters. The tiles 10 may also be provided with a cavity on the back face 14. Also as an example, the sides 16 and/or 18 of adjacent tiles may be disposed with a separation of about 2.5 millimeters. The links 20 may comprise a substantially rectangular shape with sides measuring about 5 millimeters and a thickness of about 1.5 millimeters. It is within the scope of the present invention that the links 20 be disposed on the bottom half of the tile 10, i.e., towards the back face 14, such that they are not visible once the tile assembly 1 is installed. Also by way of example, and as represented in the illustrative embodiments of FIGS. 1-2 and 5-6, the height 34 and/or length 32 of the tile assembly 1 may comprise 325 millimeters per side. Spacers 22 may be selectively disposed around the tile assembly 1 to maintain an intended separation and/or orientation of the tiles. Such spacers 22 may comprise a length of about 2.5 millimeters, a width of about 5 millimeters and/or a thickness of about 1.5 millimeters. The spacers 22 may also be disposed towards the bottom half of the tiles 10, i.e., towards the back ace 14, such that they are not visible once the assembly 1 is installed in the floor or wall surface.

Figure 3:
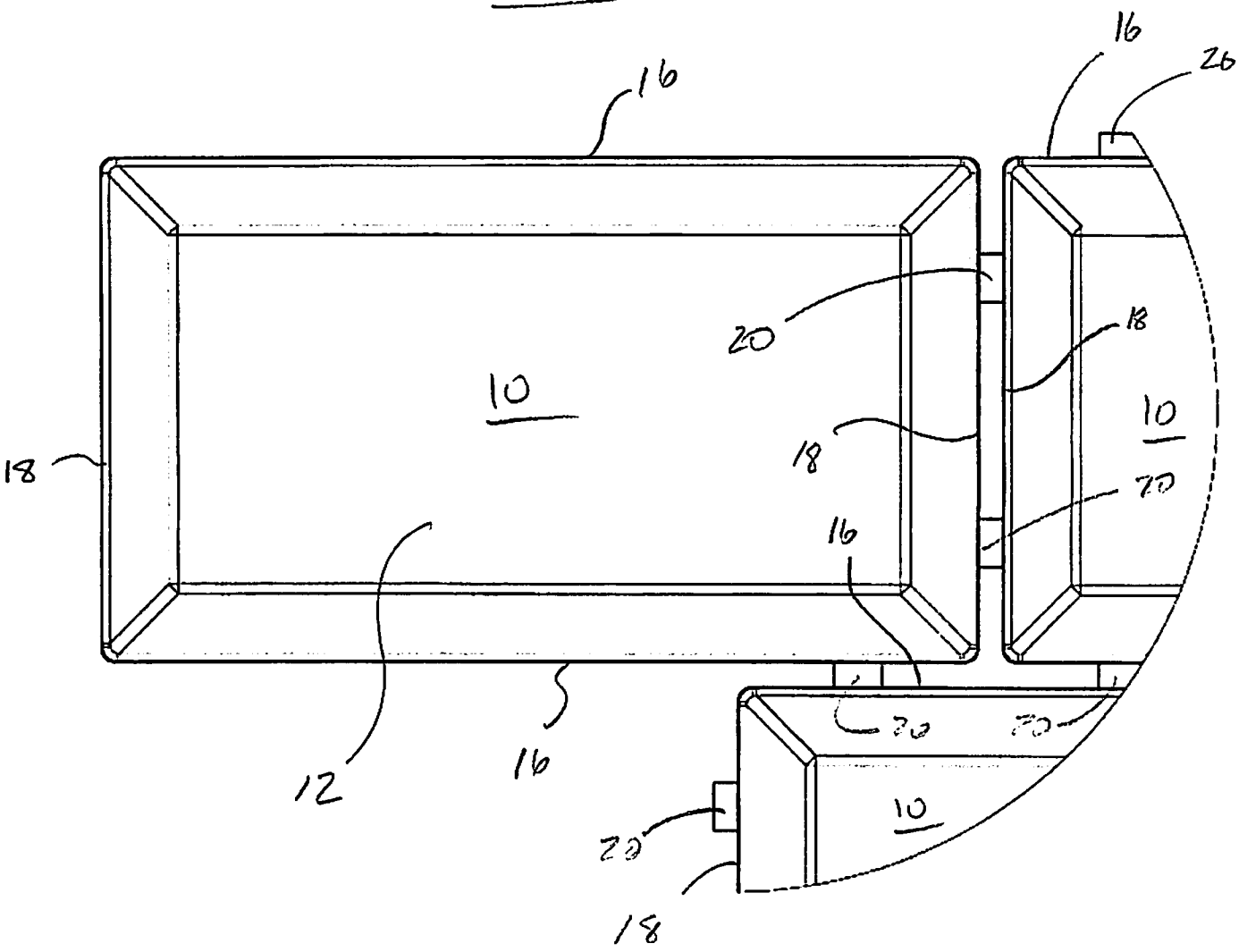
FIG. 3. is a top view of one embodiment of the front face of a tile and a portion of the front face two other tiles of the plurality of mosaic tiles according to the mosaic tile assembly of the present invention.
Figure 6:
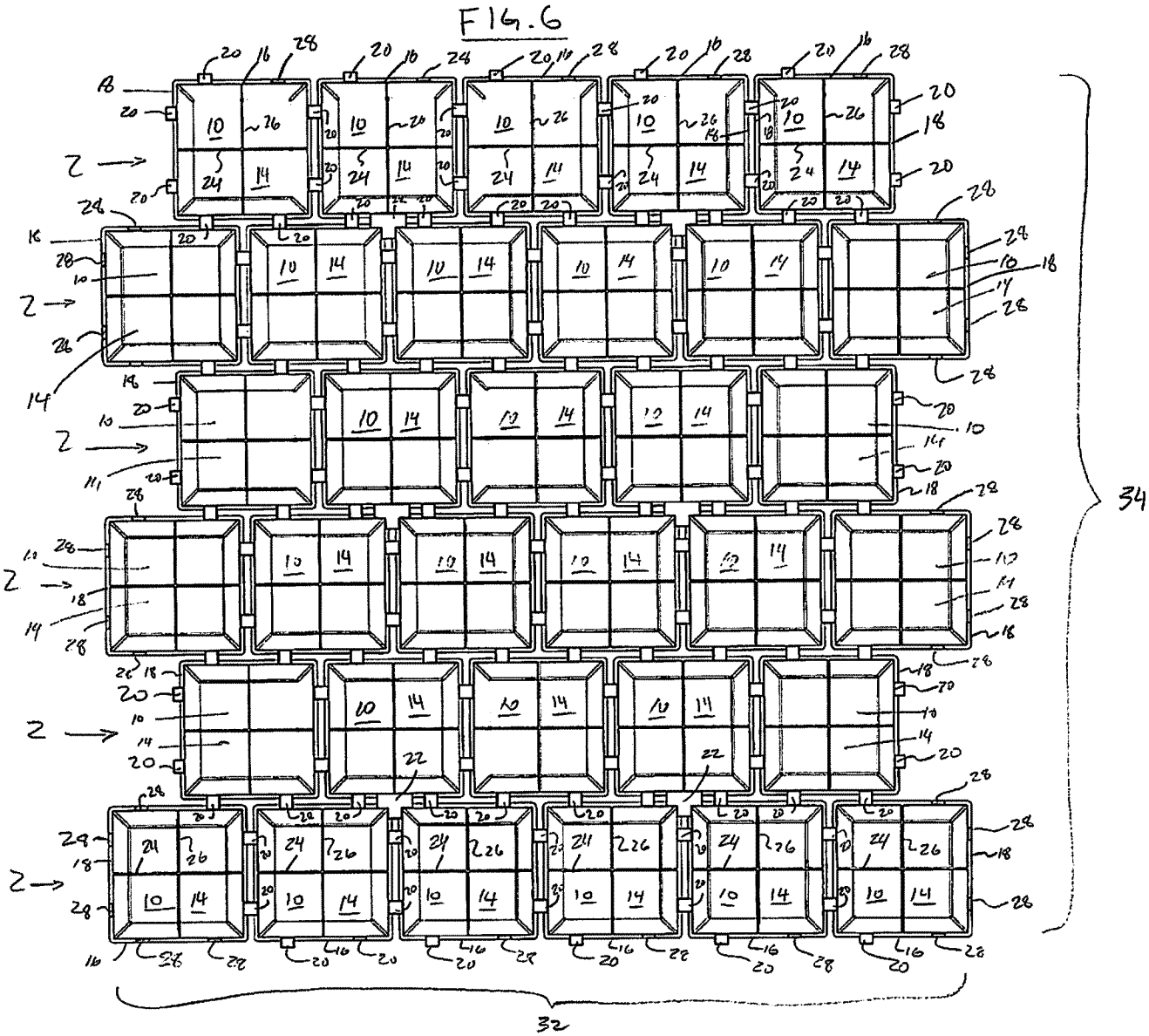
FIG. 6 is a top view of one embodiment of the back faces of the tiles of the mosaic tile assembly according the present invention.

With reference now to FIGS. 1, 3 and 6, each mosaic tile 10 according to the present invention generally comprises a front face 12, which may comprise a structure, configuration, design, or other component, that is either configured, structured, or otherwise intended to be the viewable face of the tiles 10 when disposed on the floor or wall surface. It is within the scope of the present invention, that during the contemplated continuous plastic injection process through which the assembly 1 is formed, that a colorant, dye, or other decorative component may be added. As such, the front faces 12 of the tiles 10 may comprise a finish, i.e., color, texture, graphic pattern, or other visual element, that is intended to be the viewable side of the tiles that is exposed to the exterior. Said differently, the front face 12 of the tiles 10 is the face that will be opposite to the floor or wall surface.

Figure 2:
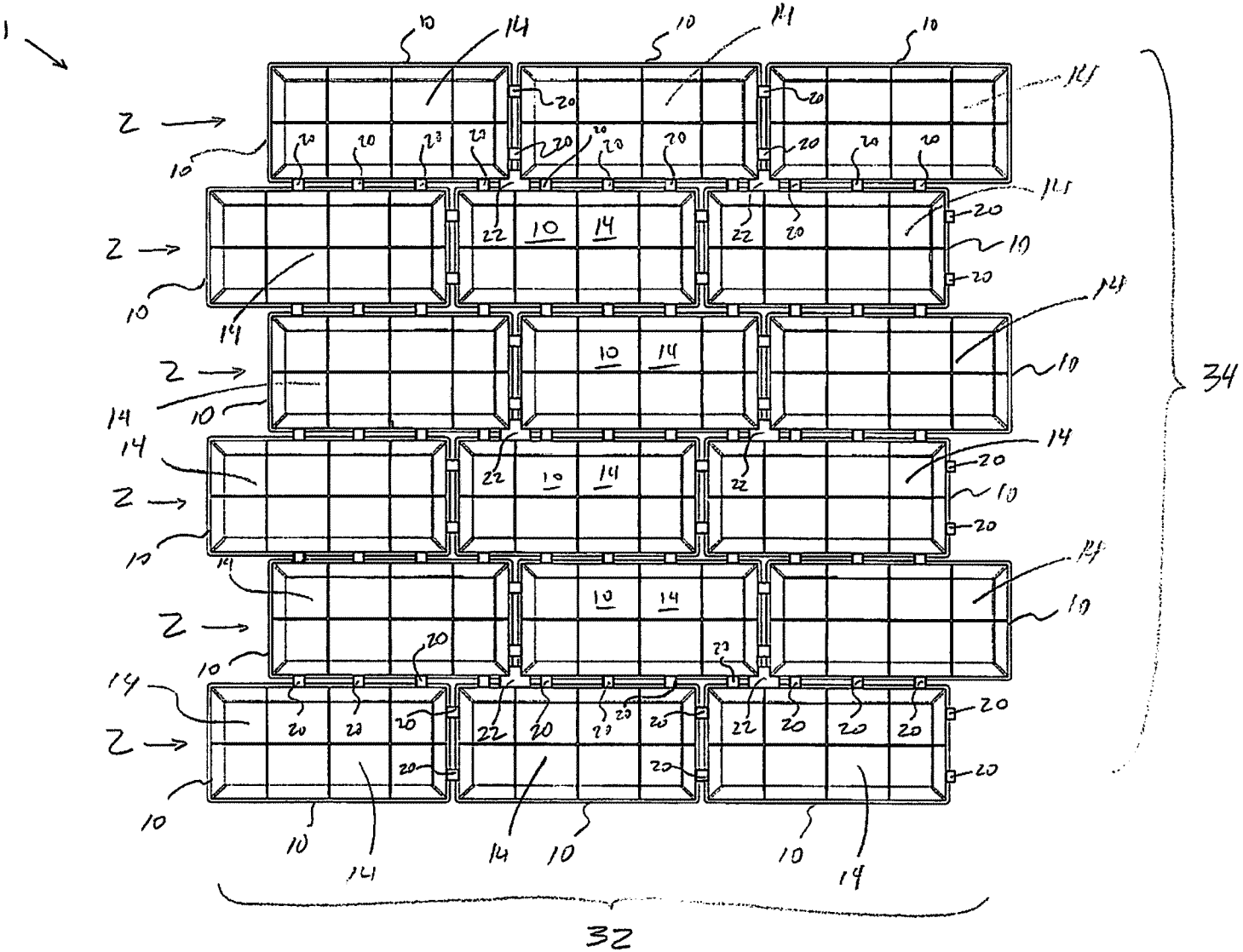
FIG. 2. is a top view of one embodiment of the back faces of the tiles of the mosaic tile assembly according the present invention.
Figure 4:
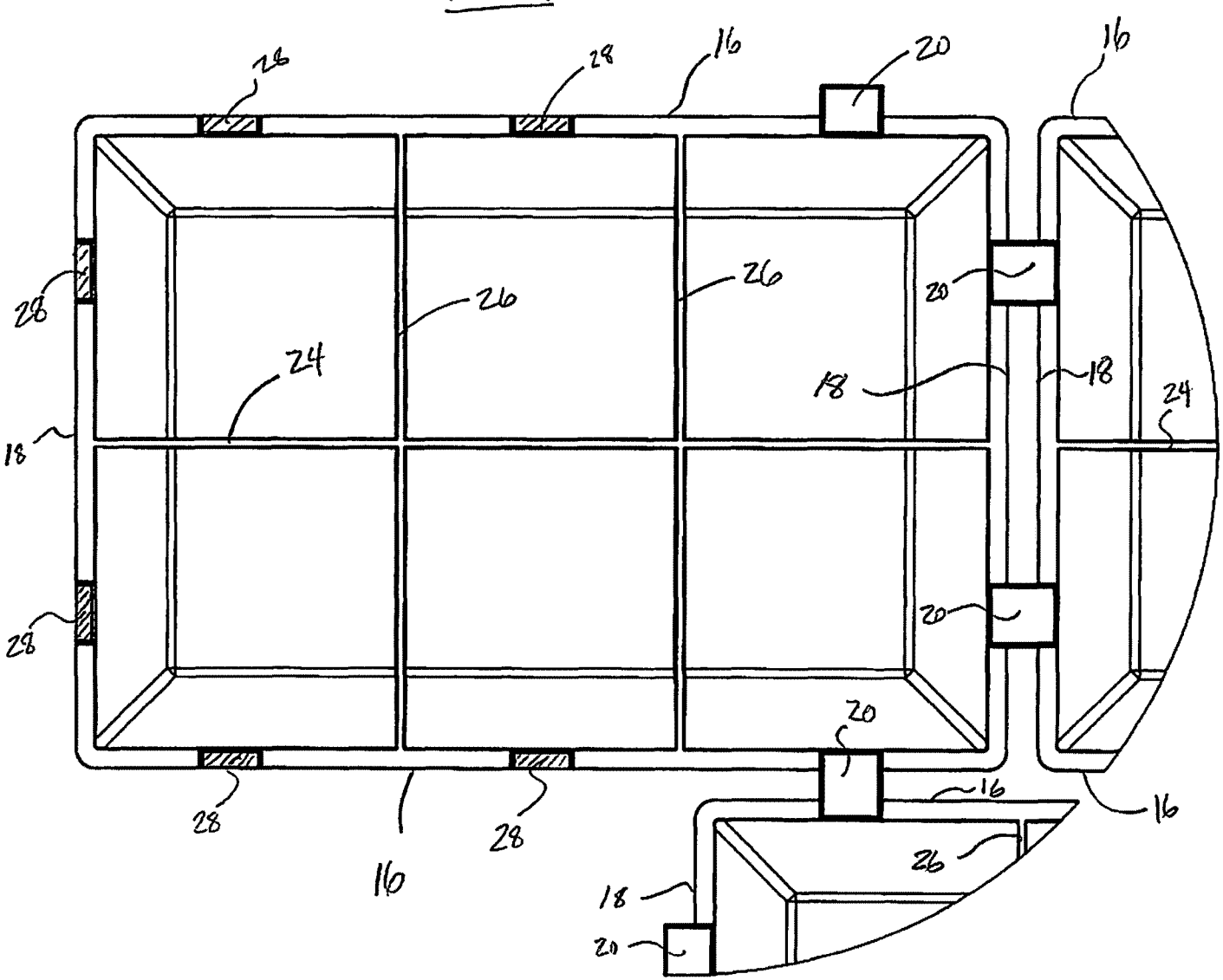
FIG. 4. is a top view of one embodiment of the back face a tile and a portion of the back face of two other tiles of the plurality of mosaic tiles according to the mosaic tile assembly of the present invention.
Figure 5:
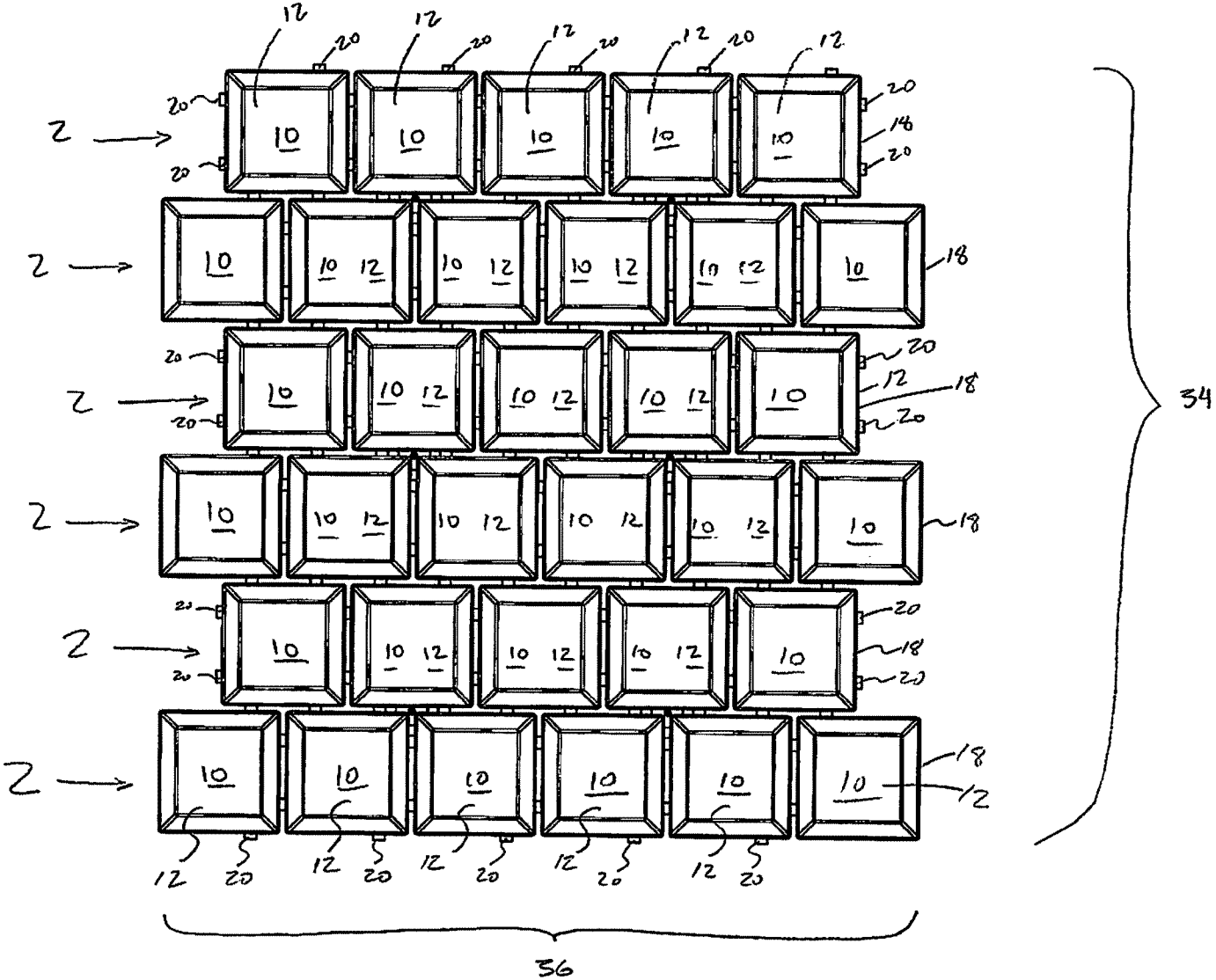
FIG. 5. is a top view of another embodiment of the front faces of the tiles of the mosaic tile assembly according the present invention.

On the other hand, and with reference to FIGS. 2, 4 and 6, the back face 14 of the tiles 10 is the face that will be disposed against the floor or wall surface when the tile assembly 1, and consequently the tiles 10, are installed on the floor or wall surface. As mentioned above, the tile assembly 1 according to the present invention may be manufactured or otherwise formed in a continuous mold injection process. That is, the individual tiles 10 may comprise a plastic with a polymer base and may be collectively formed in a mold structured to form the individual tiles 10 and rows 2 of the assembly 1. For example, the polymer base may comprise polypropylene with additives. Furthermore, the individual tiles 10 may be connected to one another via links 20, which may be either disposed on sockets 28, or may otherwise be formed on the sides 16 and/or 18 of the tiles 10 via a continuous plastic injection process in the same mold. Said differently, the mold may comprise a negative of the tile 10, including the specific shapes of the tiles 10 and/or links 20, such that through a single, continuous mold injection process, the overall assembly 1 may be formed as a unitary component of tiles 10 and/or links 20.

In addition, spacers 22, e.g., at the intersection of the corners of adjacent tiles 10 within a row 2, may also be provided to ensure stability. For example, the spacers 22 may be formed during the plastic injection process or during installation. In addition, the tiles 10 of the edges of the assembly 1, i.e., top row 2, bottom row 2, left most tiles 10, right most tiles 10, may comprise, or may otherwise be manufactured or formed with sockets 28 on the sides 16 and/or 18, such that they may be connected to other unconnected links 20 of another assembly 1 or assembly. Thus, it is contemplated, that at the sides 16 and/or 18 be aligned with the edges of the assembly 1, there may be a combination of tiles 10 with sockets 28 and/or unconnected links 20, e.g., FIG. 3-4. The sockets 28 should be configured and dimension for insertion of a corresponding links 20 from other tiles 10.

With reference now to at least FIGS. 2 and 4, and as briefly mentioned above, individual and successive rows 2 of tiles 10 of the assembly 1 may be disposed at a horizontally offset relation to one another. This may be done not only to reduce weakness points, i.e., an intersection of four different corners of different tiles 10 at the same point, but also to ensure a beneficial alignment of the grooves 26 and/or 24. It should be noted that the horizontal groove 24 may substantially extend between opposite vertical sides 18 of the same tile 10, and that the vertical grooves 26 may also extend between opposite horizontal sides 16 of the same tile. Furthermore, it is contemplated that each groove 24 and/or 26 extend from the back face 14 and into the thickness of the tile 10. Some grooves 24 and/or 26 may extend into at least half of the thickness of the tile 10, whereas other grooves may extend into more than half of the thickness of the tile 10, including about two thirds of the thickness to about three quarters to of the thickness of the tile 10.

With specific reference to FIG. 2, the grooves 26 and/or 24 may be disposed in a predetermined array that at least partially increases stability and/or also allows for an adhesive material to continuously efficiently adhere to the back face 14 of the tiles 10. The predetermined array of the grooves 26 and/or 24 may comprise at least one horizontal groove 24 disposed in an intersecting relation to the vertical grooves 26. As such, the horizontal groove(s) 24 of adjacent tiles 10 of the same row 2, may substantially define an extended horizontal channel that extends across the length of the tile assembly 1. As may be appreciated at least in FIG. 2, the predetermined array may also comprise vertical grooves 26 of tiles 10 of different adjacent rows 2 being aligned with respect to one another. As such, the grooves 26 of different tiles 10 of different successive rows 2 may collectively define an extended vertical channel that extends across the length of the assembly 1.

For example, as seen in FIG. 2, a tile 10 may be provided comprising three vertical grooves 26, which are generally disposed in a spaced apart relation to one another. A first, or leftmost vertical grooves 26 of one tile 10 may be aligned with a second or middle vertical groove 26 of the tile 10 and row 2 below. Similarly, the second or middle groove 26 of such tile 10 may be aligned with the third or rightmost groove 26 of the tile 10 and row 2 below. As such, the grooves 26 of each tile 10 may be used to form at least two extended vertical channels that span along the top and bottom edges of the tile assembly 10. In turn, the extended horizontal and vertical channels that are formed by the groves 24 and/or 26 provide for an attachment mechanism that allows an adhesive to be at least partially distributed along the groves 24 and/or 26 forming continuous structures where the adhesive at least partially attaches into the tile along the channels. This is beneficial as provides a vertical and a horizontal means of attachment into the thickness of each tile 10 that at least partially reduces separation of the tile assembly 1 from the floor or wall surface and that provides for an increase structural integrity of the tile assembly 1 once it is installed on the floor or wall surface.

In addition to the foregoing, the tiles 10 may be provided comprising other shapes, for example, elongated rectangular shapes that may comprise more than three vertical grooves 26, including four or more vertical grooves 26. The tiles may also comprise multiple horizontal grooves 24, including two or more, which are also generally disposed in a spaced apart relation to one another. In addition, tiles 10 may also be provided comprising only one vertical 24 groove and only one horizontal groove 24, i.e., FIGS. 5-6. However, one aspect of the predetermined array is that the horizontal grooves 24 and vertical grooves 26 will generally intersect one another at a substantially perpendicular or transverse direction. For example, the vertical grooves 26 of different tiles 10 of different rows 2 may be collectively disposed in a substantially perpendicular alignment to the horizontal plane and/or the horizontal grooves 24 of the tiles 10 of an assembly 1. Also as an example, the horizontal grooves 24 of different tiles 10 of the same row 2 may be aligned with one another in a substantially perpendicular alignment to the vertical plane and/or the vertical grooves 26 of different tiles 10 of an assembly 1.

Additional features of the mosaic tile assembly 1 according to the present invention comprise manufacturing the grooves 24 and/or 26 of the tiles 10 in the same continuous plastic mold injection process where the tiles 10 and/or links 20 are manufactured. For example, the mold that is used in the manufacturing process may be provided with protrusions configured and dimensioned to form the grooves 24 and/or 26 on the tiles 10. Alternatively, the grooves 24 and/or 26 may be formed after the tile assembly 1 is manufactured. For example, the grooves 4 and/or 26 may be scored, routed, indented or otherwise cut into the back face 14 of the tiles once the assembly is taken out of the plastic-injection mold.

Figure 7:
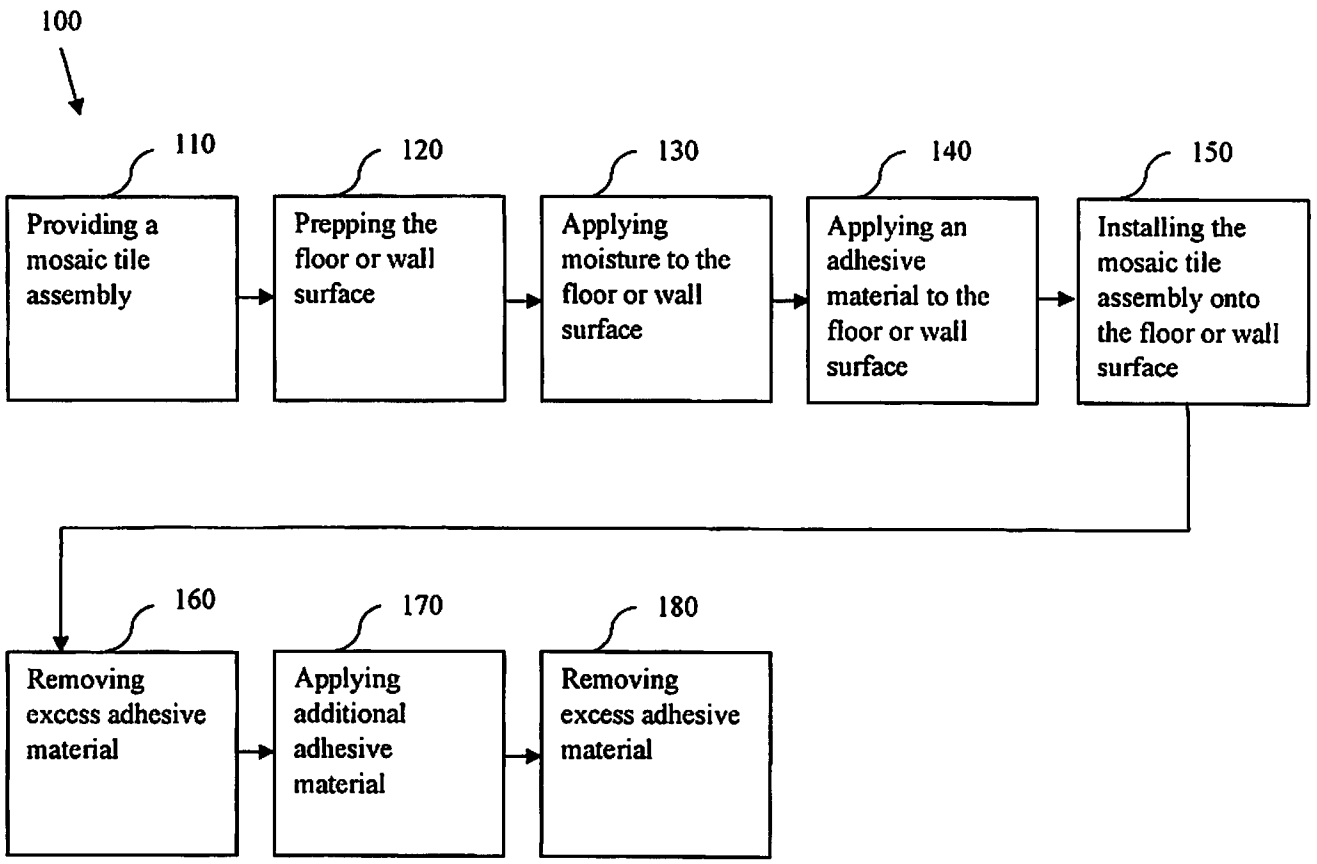
FIG. 7 is a diagrammatic representation of one embodiment of the method according to the present invention.
Figure 8:
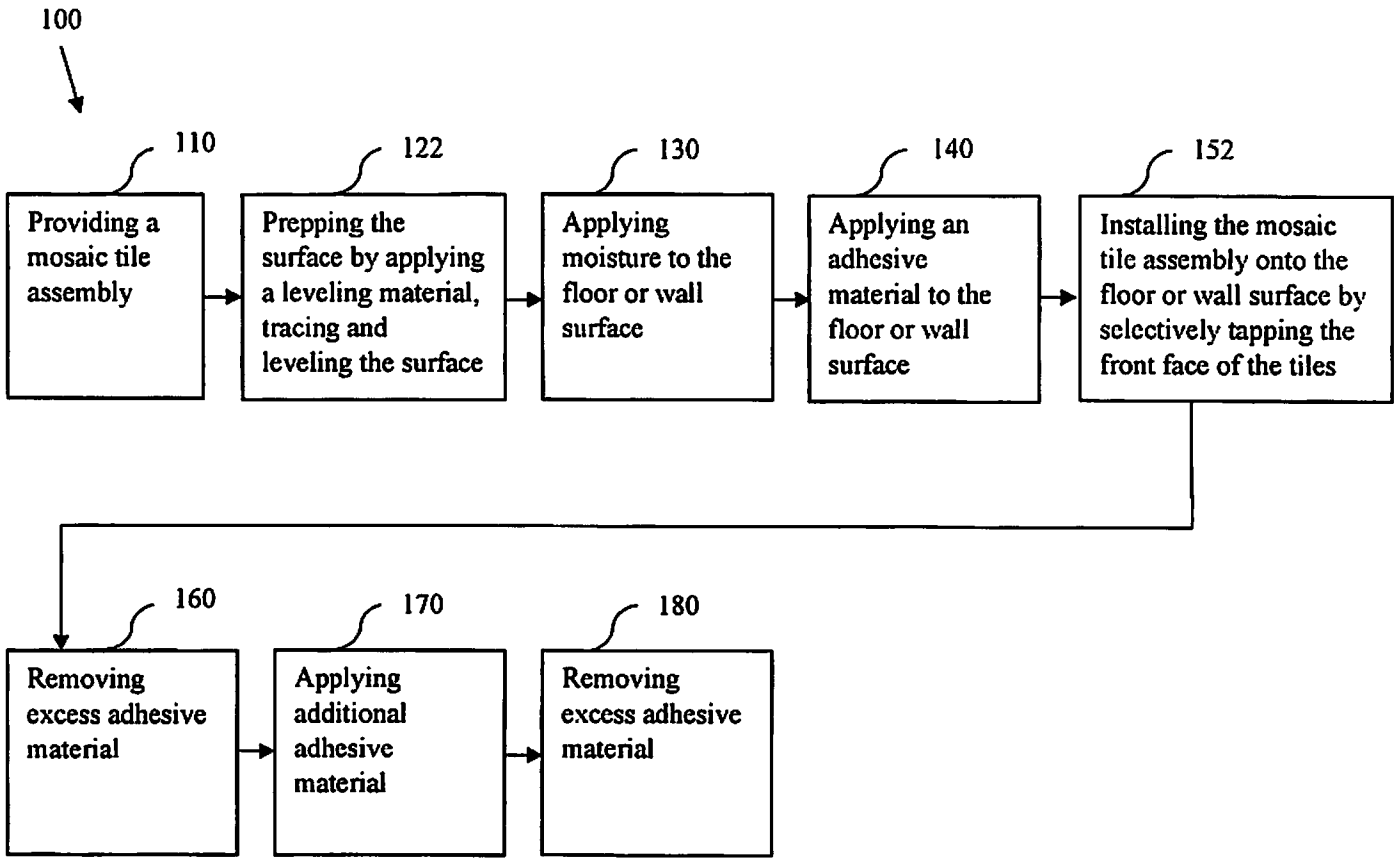
FIG. 8 is a diagrammatic representation of another embodiment of the method according to the present invention.

With reference now to FIGS. 7-8, the present invention is directed to a method 100 of installing the mosaic tile assembly 1 described herein onto a floor or wall surface. As indicated at 110, the method 100 may comprise providing a mosaic tile assembly 1 as described herein. As indicated at 120, the method 100 may comprise prepping or preparing the floor or wall surface. This may further involve comprise prepping the floor or wall surface by cleaning the floor or wall surface 120 by cleaning the floor or wall surface to substantially eliminate dust and excess moisture. As shown at 122 in FIG. 8, prepping the floor or wall surface may comprise applying a leveling material to the floor or wall surface and/or tracing and leveling the floor or wall surface to at least partially provide for a substantially square and/or even alignment of the floor or wall surface. This may involve applying the leveling material as needed throughout the floor or wall surface until it is flush to the plane of alignment, i.e., horizontal plane for floor surfaces or vertical plane for wall surfaces. Prepping the floor or wall surface 120 may also comprise providing a texture to the floor or wall surface, i.e., by applying finishing equipment and/or tools, to provide for a surface that at least partially enables adhesion. Such finishing equipment may be applied to create a rough, porous, semi-porous, textured, semi-textured, ridged and/or other types of finishing textures that may at least partially enable adhesion. However, combinations of leveling compounds and/or mixtures as well as finishing equipment may also be implemented to enable a substantially smooth surface.

With reference again to FIGS. 7-8, and as shown at 130 the inventive method 100 further comprises applying moisture to the floor or wall surface to at least partially enhance adhesion of the tile assembly 1. A moist surface at least partially enables an increased effect of an adhesive that will be applied later to install the tile assembly 1. Moisture and/or humidity conditions should be taken into account to determine an appropriate amount of moisture that may be added, i.e., water free of contaminants, dirt and/or debris. As shown at 140, the method 100 may further comprise applying an adhesive material to the floor or wall surface to form an adhesive layer. Even though, various adhesive materials, mixtures, and/or compounds may be used, the actual adhesive material used should provide for sufficient strength to hold the tile 1 assembly in its intended position once the installation is complete, but should also allow for an installer to physically adjust the position of the tile assembly 1 with respect to the surface, in multiple directions and with respect to the depth of the adhesive material, i.e., towards the actual floor or wall surface, to allow for a substantially coplanar alignment with respect to the plane of installation, i.e., horizontal for floors or vertical for walls.

As shown at 150, the method 100 further comprises installing the mosaic tile assembly 1 onto the floor or wall surface. As shown at 152 in FIG. 8, this may involve installing the mosaic tile assembly 1 onto the surface by selectively tapping the front face of at least some of the tiles 10 of the assembly 1. Such tapping, may be done with appropriate tools and/or equipment, including, without limitation, hammers, padded hammers, padded tools and/or other tools suitable to distribute the force of an impact onto the face of the tiles along a surrounding area of the tile assembly 1 without causing damage to the actual tiles 10 and/or links 20. Such tapping action 152 may also work to distribute the adhesive material into the grooves 24 and/or 26 of the back face 14 of the tiles 10. Further, the selective tapping described above need not be conducted on the entire surface of the tiles 10, but may be done on a portion of them as necessary to enable a substantial adhesion of the tiles 10 to the surface, adjust the position of the tile assembly 1, including depth within the adhesive material. For beneficial results, the resulting thickness of the adhesive layer should not exceed five millimeters. Once an initial positioning of the tile assembly 1 has been achieved, adjustments may be conducted, i.e., rotation of the tile assembly 1 within the fresh or otherwise malleable adhesive material, depth corrections by pushing into the adhesive materials and/or tapping the tiles or simply a physical reposition of the assembly 1 if necessary, i.e., removing and replacing the assembly.

The method 100 may further comprise removing excess adhesive material 160 from the front or otherwise exterior of the assembly 1. This may include removing excess materials form the joints and/or front face 12 of the tiles 10. As shown at 170, the method 100 may further comprise applying and distributing additional adhesive material on an exterior of the tile assembly 1. This may be done to correct geometrical imperfections along the joints of the tiles 10 and or further level the overall joint profile to enable a substantially uniform and/or even appearance of the front or otherwise exterior of the tile assembly 1. As shown at 180, the method 100 may further comprise removing excess of the additional adhesive material from the joints and/or exterior of the tile assembly 1. The method 100 may providing a final clean to the exterior of the tile surface 1. This may be done with previously moist sponges, towels, wool, steel wool, or other comparable tools and or objects which may at partially assist in removing excess adhesive particles, including polymers, cementitious mortars, epoxy, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A mosaic tile assembly for installation on a floor or wall surface, said mosaic tile assembly comprising:

a plurality of mosaic tiles, each one comprising:

a front face and a back face, said front face comprising a front surface configured for exposure to the exterior, said back face comprising a back surface and a plurality of grooves disposed in a predetermined array, said back surface and each one of said plurality of grooves collectively configured for attachment to the floor or wall surface, two oppositely disposed horizontal sides and two oppositely disposed vertical sides collectively defining a quadrilateral tile shape, a plurality of links, a first group of said plurality of links configured to connect vertical sides of different and adjacent ones of said plurality of mosaic tiles, a second group of said plurality of links configured to connect horizontal sides of different and adjacent ones of said plurality of mosaic tiles, each one of said plurality of mosaic tiles collectively disposed in a staggered arrangement comprising:

a plurality of rows of adjacently disposed ones of said plurality of mosaic tiles, each one of said plurality of rows disposed at an offset relationship to a different adjacent row of said plurality of mosaic tiles, at least one extended vertical channel defined by a group of vertically aligned grooves of said plurality of grooves of individual ones of said plurality of mosaic tiles of adjacently disposed ones of said plurality of rows, at least one extended horizontal channel defined by a group of horizontally aligned grooves of said plurality of grooves of individual ones of adjacently disposed ones of said plurality of tiles of a same one said plurality of rows.

2. The mosaic tile assembly as recited in claim 1 wherein said predetermined array comprises said at least one extended horizontal channel spanning from a right end to a left end of said predetermined array, and said at least one extended vertical channel comprises at least two extended vertical channels spanning from a bottom end to a top end of said predetermined array.

3. The mosaic tile assembly as recited in claim 2 wherein said predetermined array comprises said at least one extended horizontal channel disposed in an intersecting relation to each of said at least two extended vertical channels;

at least one of said horizontally aligned grooves of an individual one of said plurality of mosaic tiles disposed in an intersecting relation to said at least one vertically aligned groove of the same one of said plurality of mosaic tiles.

4. The mosaic tile as recited in claim 2 wherein individual said vertically aligned grooves of the same one of said plurality of mosaic tiles are disposed in spaced apart relation to one another; individual said horizontally aligned grooves of the same one of said plurality of mosaic tiles are disposed in spaced apart relation to one another; said at least two extended vertical channels are disposed in a spaced apart relation to one another.

5. The mosaic tile assembly as recited in claim 2 further comprising said at least two extended horizontal channels and said at least two extended vertical channels; said at least two extended horizontal channels disposed in a spaced apart relation to one another and said at least two extended vertical channels disposed in a spaced apart relation to one another.

6. The mosaic tile assembly as recited in claim 2 wherein individual ones of said plurality of grooves of each one of said plurality of mosaic tiles substantially extend into more than half of the thickness of each one of said plurality of mosaic tiles the tile from said back surface.

7. The mosaic tile assembly as recited in claim 2 wherein at least a horizontal one of said plurality of grooves of each of said plurality of mosaic tiles at least partially extends between said two oppositely disposed vertical sides thereof and at least two vertical ones of said plurality of grooves of each of said plurality of mosaic tiles at least partially extend between oppositely disposed horizontal sides thereof.

8. The mosaic tile assembly as recited in claim 2 further comprising two said extended horizontal channels extending between a left end and right end of said mosaic tile assembly and four said extended vertical channels extending between a top end and a bottom end of said mosaic tile assembly; each one of said two extended horizontal channels disposed in an intersecting relation to each of said four extended vertical channels.

9. The mosaic tile assembly as recited in claim 1 wherein each one of said plurality of mosaic tiles comprises a polymer-base plastic.

10. The mosaic tile assembly as recited in claim 1 wherein all of said plurality of mosaic tiles are formed with a plastic injection mold in a continuous plastic mold injection process.

11. A mosaic tile assembly formed with a plastic injection mold in a continuous plastic injection process and configured for installation on a floor or wall surface, said mosaic tile assembly comprising:

a plurality of mosaic tiles, each one comprising:

a front face and a back face, said front face comprising a front surface configured for exposure to the exterior, said back face comprising a back surface and a plurality of grooves disposed in a predetermined array, said back surface and said plurality of grooves configured for attachment onto the floor or wall surface, two oppositely disposed horizontal sides and two oppositely disposed vertical sides collectively defining a rectangular shape, said predetermined array comprising at least one horizontal groove of said plurality of grooves extending between said two oppositely disposed vertical sides and three vertical grooves of said plurality of grooves extending between said two oppositely disposed horizontal mosaic tiles, said three vertical grooves disposed in a spaced apart relation to one another and said at least one horizontal groove disposed in an intersection relation to each of said three vertical grooves, each one of said back surface and said plurality of grooves collectively configured for attachment to the floor or wall surface, a plurality of links, a first group of said plurality of links disposed between vertical sides of different and adjacent ones of said plurality of mosaic tiles, a second group of said plurality of links disposed between horizontal sides of different and adjacent ones of said plurality of mosaic tiles, and each one of said plurality of mosaic tiles collectively disposed in a staggered arrangement comprising:

a plurality of rows of adjacently disposed ones of said plurality of mosaic tiles, each one of said plurality of rows disposed at a horizontal offset relationship to a different adjacent row of said plurality of mosaic tiles, a left vertical groove of said plurality of grooves of a first mosaic tile of one of said plurality of rows disposed in a substantially vertical alignment to a middle vertical groove of said plurality of grooves of a different and adjacently disposed mosaic tile of a different one of said plurality of rows, said left vertical groove and said middle vertical groove of said different and adjacently disposed mosaic tile collectively defining at least a portion of a first extended vertical channel, and a middle vertical groove of said plurality of grooves of said first mosaic tile of one of said plurality of rows is vertically aligned with a right vertical groove of said plurality of grooves of an adjacently disposed mosaic tile of a different one of said plurality of rows, said middle vertical groove of said first mosaic tile and said right vertical groove collectively defining a second extended vertical channel.

12. The mosaic tile assembly as recited in claim 11 wherein all of said plurality of mosaic tiles and all of said plurality of links are manufactured in a mold via a continuous plastic injection process.

13. A method of installing a mosaic tile assembly on a floor or wall surface, the method comprising:

providing a mosaic tile assembly comprising:

a plurality of mosaic tiles, each one comprising:

a front face and a back face, said front face comprising a front surface configured for exposure to the exterior, said back face comprising a back surface and a plurality of grooves disposed in a predetermined array, said back surface and each one of said plurality of grooves collectively configured for attachment to the floor or wall surface, two oppositely disposed horizontal sides and two oppositely disposed vertical sides collectively defining a quadrilateral tile shape, a plurality of links, a first group of said plurality of links configured to connect vertical sides of different and adjacent ones of said plurality of mosaic tiles, a second group of said plurality of links configured to connect horizontal sides of different and adjacent ones of said plurality of mosaic tiles, and each one of said plurality of mosaic tiles collectively disposed in a staggered arrangement comprising:

a plurality of rows of adjacently disposed ones of said plurality of mosaic tiles, each one of said plurality of rows disposed at an offset relationship to a different adjacent row of said plurality of mosaic tiles, at least one extended vertical channel defined by a group of aligned vertical grooves of individual ones of said plurality of mosaic tiles of adjacently disposed ones of said plurality of rows, at least one extended horizontal channel defined by a group of horizontally aligned grooves of individual, adjacently disposed ones of said plurality of tiles of a same one of said plurality of rows, prepping the floor or wall surface, applying moisture to the surface to at least partially enhance adhesion, applying an adhesive material to the floor or wall surface to form an adhesive layer, installing the mosaic tile assembly on the floor or wall surface, removing excess adhesive material, applying and distributing additional adhesive material on an exterior of the tile assembly, removing additional excess adhesive material from the joints and the exterior of the tile assembly, and cleaning the exterior surface.

14. The method as recited in claim 13 wherein installing the mosaic tile assembly on the floor or wall surface comprises installing the mosaic tile assembly on the floor or wall surface by selectively tapping on the front face of at least some of the plurality of tiles towards the floor or wall surface to at least partially enable a substantially uniform distribution of the adhesive material at least along the plurality of grooves.

15. The method as recited in claim 13 wherein prepping the floor or wall surface comprises prepping the floor or wall surface by:

applying a leveling material to the floor or wall surface, and tracing and leveling the floor or wall surface to at least partially provide for a substantially square and even alignment of the floor or wall surface, and a texture that at least partially enhances adhesion.

16. The method as recited in claim 13 wherein applying an adhesive material to the floor or wall surface to form an adhesive layer comprises applying an adhesive material to the floor or wall surface to form an adhesive layer not exceeding about 5 millimeters in thickness.

* * * * *